US006394430B1

(12) United States Patent
Forschner et al.

(10) Patent No.: US 6,394,430 B1
(45) Date of Patent: May 28, 2002

(54) AUTO-ASPIRATING ROTATIONAL DISPERSION DEVICE

(75) Inventors: Peter Forschner, Hasel; Rainer Krebs, Schopfheim; Hans-Jürgen Weiß, Kandern, all of (DE)

(73) Assignee: Ekato Rühr-und Mischtechnik GmbH, Schopfheim (DE)

( * ) Notice: Subject to any disclaimer, the term of this patent is extended or adjusted under 35 U.S.C. 154(b) by 0 days.

(21) Appl. No.: 09/418,000

(22) Filed: Oct. 13, 1999

(30) Foreign Application Priority Data

Oct. 13, 1998 (DE) ..... 298 18 255 U

(51) Int. Cl.[7] ..... B01F 3/04
(52) U.S. Cl. ..... 261/87; 261/93
(58) Field of Search ..... 261/84, 87, 91, 261/93, 28, 29

(56) References Cited

U.S. PATENT DOCUMENTS

| | | | | | |
|---|---|---|---|---|---|
| 1,526,596 | A | * | 2/1925 | Greenwalt | 261/93 |
| 1,579,355 | A | * | 4/1926 | Greenwalt | 261/93 |
| 3,485,484 | A | * | 12/1969 | Quinchon | 261/87 |
| 3,776,531 | A | * | 12/1973 | Ebner et al. | 261/87 |
| 3,813,086 | A | * | 5/1974 | Ebner et al. | 261/93 |
| 4,283,357 | A | * | 8/1981 | Sidery | 261/87 |
| 4,611,790 | A | * | 9/1986 | Otsuka et al. | 261/87 |
| 4,925,598 | A | * | 5/1990 | Kivisto et al. | 261/87 |
| 5,013,490 | A | * | 5/1991 | Tanimoto et al. | 261/87 |
| 5,389,310 | A | * | 2/1995 | Leiponen | 261/87 |
| 5,660,766 | A | * | 8/1997 | Van Dyk | 261/87 |
| 5,795,504 | A | * | 8/1998 | Berchotteau | 261/87 |

FOREIGN PATENT DOCUMENTS

| | | | | |
|---|---|---|---|---|
| GB | 745457 | * | 2/1956 | 261/87 |
| GB | 1028483 | * | 5/1966 | 261/93 |
| JP | 52-32748 | * | 8/1977 | 261/93 |
| SU | 621383 | * | 8/1978 | 261/87 |

* cited by examiner

*Primary Examiner*—C. Scott Bushey
(74) *Attorney, Agent, or Firm*—Kubovcik & Kubovcik

(57) ABSTRACT

An auto-aspirating, rotational dispersion device for gases and liquids with a rotating hollow shaft employed for gas suction and gas channels communicating with said hollow shaft to openings in the gas channels that are positioned at intervals over the circumference of the device, at which openings the gas and liquid are mixed. The device is distinguished by the fact that the gas being dispersed flows in a manner separate from the liquid, from the hollow shaft through the gas channels and is mixed with the liquid outside of the device.

11 Claims, 2 Drawing Sheets

Figure 3:
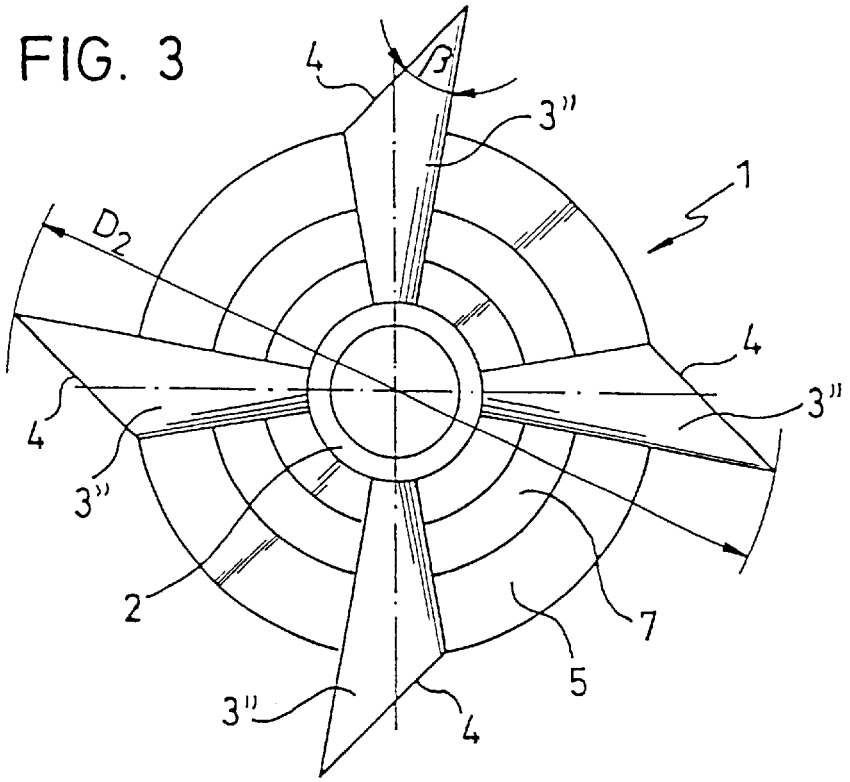

FIG. 1
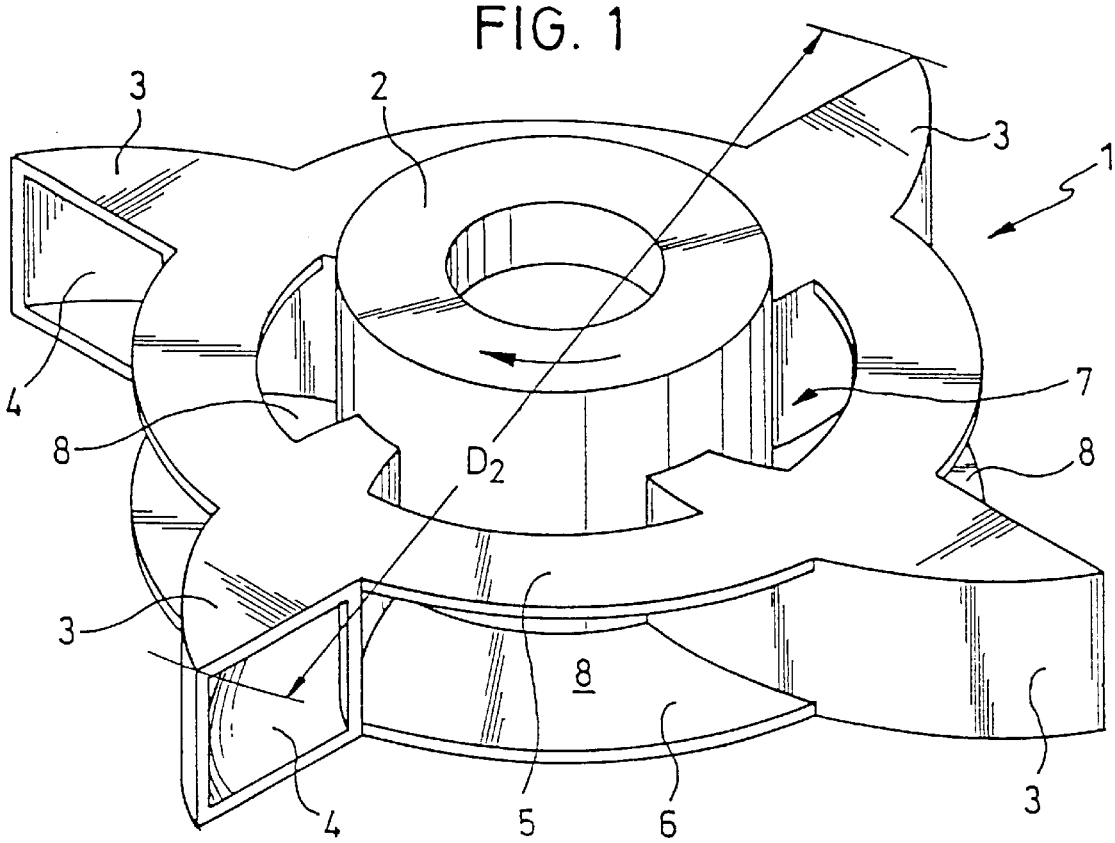
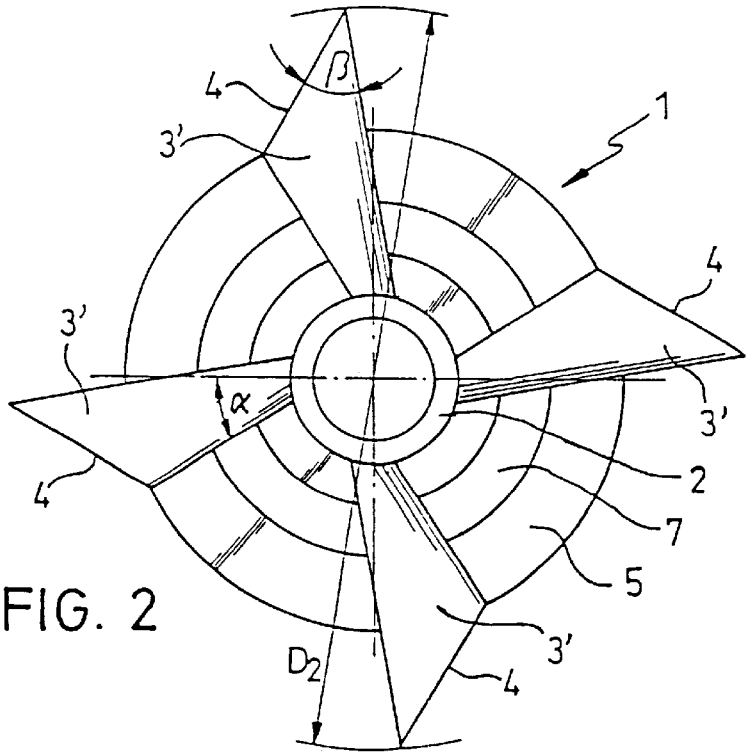
FIG. 2

AUTO-ASPIRATING ROTATIONAL DISPERSION DEVICE

BACKGROUND OF THE INVENTION

1. Field of the Invention

The invention relates to an auto-aspirating, rotational dispersion device for gases and liquids, with a rotating hollow shaft for gas suction. In particular, the invention relates to a self-priming two-phase turbine for mixing together gases and liquids.

2. Description of the Prior Art

In conventional dispersion devices or self-priming two-phase turbines of the type indicated above, gas suction occurs through the rotating hollow shaft and liquid is also introduced into the inner chamber of the turbine, with the result that the gas and liquid are mixed together inside the turbine chamber. This kind of auto-aspirating two-phase turbine works satisfactorily with a gas/liquid phase ratio of up to about 25/30%. At larger phase ratios the auto-aspirating two-phase turbine becomes flooded and even when the rpm is increased an increase in performance is impossible, since the aspirated quantity of gas remains at rest and an increased mass transfer is not possible. For this reason the conventional, self-priming two-phase turbine in its very design is restricted by the predetermined gas/liquid phase ratio with respect to the mass transfer.

The object of the invention, therefore, is to create a high performance, auto-aspirating dispersion device for gases and liquids, or as the case may be, a two-phase turbine, which device eliminates the described difficulties while permitting a greater mass transfer under the most favorable possible conditions for performance and the rpm of the dispersion device.

SUMMARY OF THE INVENTION

To this end, the invention provides for an auto-aspirating, rotational dispersion device for gases and liquids with a rotating hollow shaft employed for gas suction, which device is distinguished by the fact that the gas being dispersed flows in a manner separate from the liquid, from the hollow shaft over gas channels communicating with said hollow shaft to openings in the gas channels that are positioned at intervals over the circumference, at which openings the gas and liquid are mixed outside of the dispersion device.

DESCRIPTION OF PREFERRED EMBODIMENTS

In the auto-aspirating, rotational dispersion device according to the invention, a plurality of gas channels are therefore connected to the hollow shaft; the gas being dispersed is thereby provided with an outlet through openings in the gas channels. The separation of flow creates a negative pressure at the gas channel openings which allows the gas to be aspirated from the gas chamber, against the static liquid head, through the dispersion device. The dispersion device according to the invention thereby assures continuous gas suction independent of the gas/liquid phase ratio, as based on the stall phenomenon at the gas channel opening. In the dispersion device according to the invention, moreover, the gas and liquid are mixed outside of the inner chamber of the dispersion device, specifically, in the area of the gas channel openings, since the gas channels provided by the inventive device conduct gas, but not liquid. When the dispersion device rotates, the gas channels produce intensive liquid transport, movement, and circulation, so that a high mass transfer is achieved by the intensive contact between the moving liquid and the aspirated and dispersed gas.

The separate guidance of the dispersed gas within the auto-aspirating dispersion device according to the invention thus assures that the device is not restricted by the predetermined gas/liquid phase ratios. The invention thereby provides an extremely capable auto-aspirating rotational dispersion device, or auto-aspirating two-phase turbine, providing a high mass transfer.

The performance of this kind of auto-aspirating dispersion device can be enhanced and its effectiveness improved by the appropriate design of its gas channels. Numerous possibilities are available here.

In one embodiment the gas channels run in roughly radial fashion relative to the hollow shaft. As an alternative, the gas channels can run at an acute angle to the radius, preferably in a range between 0 and 25°, particularly about 15°.

Furthermore, the gas channels can be designed in the form of agitator blades, to further intensify the liquid transport.

In the auto-aspirating, rotational dispersion device according to the invention, the gas channels will preferably have a curved design, so as to have a profile favorable to the material flow and one that promotes intensive liquid transport. The curvature radius can lie in a range from $D_2/\mathbf{3}$ to $\mathbf{3}D_2$, but will preferably be about $D_2/\mathbf{2}$. $D_2$ indicates the maximum diameter of the dispersion device, as measured from the outer edges of two opposite gas channel openings.

In particular, the gas channels can exhibit a cross-section that increases in size as it moves outward from the hollow shaft to the gas channel opening. This intensifies the suction of gas from the gas compartment, as based on the separation-of-flow phenomenon and the resulting negative pressure in the gas channel system.

In particular, the cross-section of each gas channel opening lies on a plane running at an acute angle to the gas channel wall; the angle will ideally lie in a range from 30° to 60°, and more specifically will amount to 50°. This allows the mass transfer to be further improved due to the increased contact areas.

According to a preferred embodiment of the auto-aspirating, rotational dispersion device, the gas channels are positioned at regular angular distances over the circumference, so as to guarantee as uniform as possible a mixture of gas and liquid in the circumferential direction.

According to another embodiment of the auto-aspirating, rotational dispersion device according to the invention, cover disks are provided above and below the gas channels; the cover disks are spaced in axial fashion relative to the rotating hollow shaft and form compartments in conjunction with the gas channels. The lower cover disk can form a closed area which is connected to the hollow shaft. Together with the outer surface of the hollow shaft the upper cover disk will ideally form a gap for the suction of liquid. Liquid is drawn through this suction gap into the compartments formed by the two axially spaced cover disks and the outer surfaces of the gas channels; intensive agitation is imparted to the liquid to intensify the mass transfer.

The gas channel openings will preferably be oriented counter to the rotating direction of the hollow shaft, so that there is intensive intermixture of gas and liquid in the area of the gas channels facing away from the flow.

Figure 4:
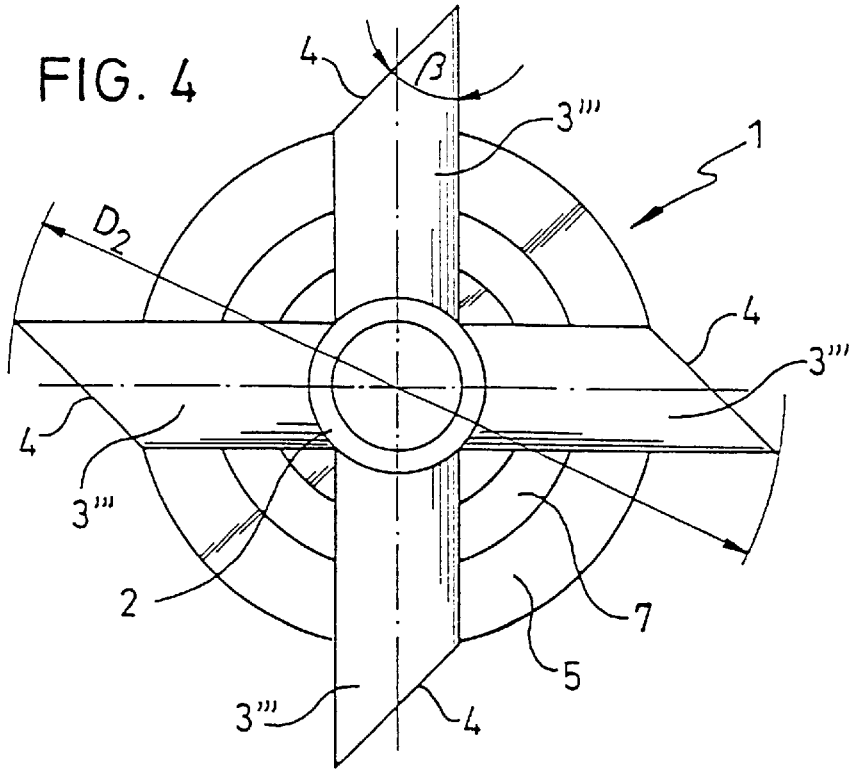

The invention will now be explained in greater detail on the basis of preferred embodiments, with reference to the attached drawing. Shown are:

FIG. 1 a schematic perspective view of an initial embodiment of an auto-aspirating, rotational dispersion device or an auto-aspirating two-phase turbine according to the invention FIG. 2 a schematic top view of a variant of a dispersion device according to the invention FIG. 3 a schematic top view of a further variant of a dispersion device according to the invention FIG. 4 a schematic top view of another embodiment of a dispersion device according to the invention FIG. 1 gives a perspective view of a self-aspirating, rotational dispersion device or an auto-aspirating two-phase turbine 1. The dispersion device 1 exhibits a central hollow shaft 2 which is driven in the direction indicated by the arrow, by a rotating drive not shown in greater detail. Gas to be dispersed is sucked into the cavity formed by the hollow shaft 2. The inner space bordered by the hollow shaft 2 communicates with a plurality of gas channels 3 which ideally are positioned at regular angular intervals over the circumference; these gas channels 3 have openings 4 that in the depicted example are oriented in a direction opposite to the rotating direction of the hollow shaft 2. A cover disk 5, 6 is provided on the upper and lower sides of the dispersion device 1. The lower cover disk 6 forms a closed area and is firmly attached to the outer wall of the hollow shaft 2 and to the corresponding outer area of the gas channels 3. The upper cover disk 5 has an annular shape and surrounds the hollow shaft 2 concentrically and forms an annular gap 7 between the outer wall of the hollow shaft 2; this annular gap 7 serves to suck liquid into the compartments 8 formed by the two cover disks 5 and 6 and the gas channels 3. The cover disks 5 and 6 can be integrally attached to the gas channels 3. The largest outer diameter of the dispersion device 1 is designated $D_2$and is measured from the outer edges of two opposite gas channel openings.

In the dispersion device 1 according to the invention, a negative pressure is produced at the gas channel openings 4 due to the separation of flow; gas is consequently sucked from the gas compartment and the gas channels 3, against the static liquid head, through the dispersion device 1. This aspirated gas, which is then to be dispersed, is conducted through a guidance system within the dispersion device 1, without being mixed with liquid, and is discharged through the gas channel openings 4; the mixing of the dispersed gas and the liquid then occurs outside of the dispersion device, in the area around the gas channel openings 4. With the rotating movement of the hollow shaft 2, the gas channels 3 bring about an intensive liquid transport and agitation, with the participation of the compartments 8. Intensive contact is thus created between the gas aspirated from the hollow shaft 2 and exiting through the gas channel openings 4, and the liquid around the gas channel openings 4 that finds itself in intense motion. The dispersion device 1 according to the invention thus provides a high mass transfer.

In the embodiment of the dispersion device shown in FIG. 1 the gas channels 3 exhibit a curvature and have a shape that resembles an agitator blade. This further intensifies the liquid transport. The curvature radius lies in a range from $D_2/3$ to $3D_2$, and will ideally amount to about $D_2/2$.

As can also be seen from FIG. 1, the gas channels 3 have a cross-section that increases in size proceeding in the direction of gas flow from the gas channel's point of attachment to the hollow shaft 2. The mass transfer from gas to liquid is thereby intensified yet further. A further benefit is represented by favorable ratios for mass transfer, inasmuch as the gas channel openings 4 are directed against the rotating direction of the hollow shaft 2.

In the embodiment of the dispersion device shown in FIG. 2, the basic structural elements agree with the embodiment according to FIG. 1. These parts, therefore, are not explained in greater detail; instead, only the differences as compared with FIG. 1 are discussed. Basically, only the gas channels 3' have a design that deviates from FIG. 1.

As can be seen from FIG. 2, the gas channels 3' are uncurved and run at an acute angle $\alpha$ relative to the radius. This acute angle $\alpha$ lies in a range between 0 and 25°, and will preferably equal about 15°. As in FIG. 1, these gas channels 3' have a cross-section which increases in size moving outward from the hollow shaft 2 toward the gas channel opening 4. The cross-section of each gas channel opening 4 lies on a plane running at an acute angle $\beta$ to the gas channel wall; the angle will ideally lie within a range from 30° to 60°, and will specifically amount to about 50°.

The dispersion device shown in FIG. 3 also exhibits gas channels 3" positioned at regular angular intervals over the circumference; as in FIG. 2, these gas channels 3" run in uncurved fashion and have a cross-section which increases in size moving outward from the hollow shaft 2 toward the gas channel opening 4. The cross-section of each gas channel opening also lies on a plane running at an acute angle $\beta$ to the gas channel wall; the angle will preferably lie within a range from 30° to 60°, and will specifically amount to about 50°. In contrast to the embodiment shown in FIG. 2, however, the gas channels 3" run in radial fashion relative to the hollow shaft 2. Otherwise, all features of the dispersion device shown in FIG. 3 fundamentally agree with those already explained in connection with FIG. 1.

FIG. 4 shows another variant in the form of a modification of the embodiment of the dispersion device 1 shown in FIG. 3. In contrast to that embodiment, the gas channels 3'" communicating with the hollow cavity of the hollow shaft 2 have a basically constant cross-section over their entire length, from the hollow shaft 2 to the gas channel openings 4. Otherwise, the gas channels 3'" also run in basically radial fashion relative to the hollow shaft 2 and have a cross-section in the area of the gas channel opening 4 on a plane that runs at an acute angle $\beta$ to the gas channel wall.

The invention is naturally not restricted to the above described embodiments and their details; rather, numerous variants and modifications are possible, which the specialist will hit upon in the case of need, without abandoning the inventive concept. In particular, combinations of differently formed gas channels, variously positioned relative to the hollow shaft, are possible; different combinations of straight and curved gas channels will also come into consideration, as well as combinations involving gas channels whose cross-sections progress in stepped fashion. All of these variants and elaborations are included in the protected subject matter according to the invention.

What is claimed is:

1. An auto-aspirating rotational dispersion device for gases and liquids comprising a hollow shaft (2) for gas suction rotatable in a first direction; gas channels (3, 3', 3", 3'") communicating with said hollow shaft (2) and extending outwardly therefrom and having a cross-section which increases in size in a direction from the hollow shaft (2), and a circumferentially positioned gas channel opening (4) at an end of each of said gas channels (3, 3', 3", 3'") and oriented in a second direction opposite the rotatable first direction of the hollow shaft (2); a lower cover disk (6) provided below said channels (3, 3', 3", 3'") and attached to an outer wall of the hollow shaft (2) and an annular upper cover disk (5) provided above said gas channels (3, 3', 3", 3'") and surrounding said hollow shaft (2) concentrically and forming an annular gap (7) with the outer wall of the hollow shaft (2); said upper cover disk (5), lower cover disk (6) and gas channels (3, 3', 3", 3'") forming compartments (8), said upper and lower cover disks (5,6) having respective outer radial peripheries, said gas channel openings (4) being positioned radially beyond the respective outer radial peripheries of said upper and lower cover disks (5,6) wherein when said device is rotated a gas to be dispersed flows in separate fashion from a liquid through the hollow shaft (2) over gas channels (3, 3', 3", 3'") to said circumferentially positioned gas channel openings (4) and liquid is sucked into said compartments (8) such that an intermixture of gas and liquid occurs outside of the dispersion device (1) in the area of the gas channel openings (4).

2. An auto-aspirating rotational dispersion device according to claim 1, wherein the gas channels (3", 3'") extend in approximately radial fashion relative to the hollow shaft (2).

3. An auto-aspirating rotational dispersion device according to claim 1, wherein the gas channels (3') extend at an acute angle ($\alpha$) to the radius.

4. An auto-aspirating rotational dispersion device according to claim 3, wherein said acute angle ($\alpha$) is in a range between 0 to 25°.

5. An auto-aspirating rotational dispersion device according to claim 1, wherein the gas channels (3, 3', 3", 3'") have the shape of agitator blades.

6. An auto-aspirating rotational dispersion device according to claim 1, wherein the gas channels (3) are curved in shape.

7. An auto-aspirating rotational dispersion device according to claim 6, wherein a radius of curvature of the gas channels (3) is in a range from $D_2/3$ to $3D_2$, where $D_2$ is the greatest diameter between the outer edges of two opposite gas channel openings.

8. An auto-aspirating rotational dispersion device according to claim 1, wherein the cross-section of each gas channel opening (4) is positioned on a plane at an acute angle ($\beta$) to the gas channel wall.

9. An auto-aspirating rotational dispersion device according to claim 8, wherein said acute angle ($\beta$) is in a range from 30° to 60°.

10. An auto-aspirating rotational dispersion device according to claim 1, wherein the gas channels (3, 3', 3", 3'") are positioned at regular angular intervals over the circumference.

11. An auto-aspirating rotational dispersion device according to claim 1, wherein the upper and lower sides of the gas channel (3, 3', 3", 3'") are provided with a cover disk (5, 6).

* * * * *